US009151105B1

(12) United States Patent
Schwalbe

(10) Patent No.: US 9,151,105 B1
(45) Date of Patent: Oct. 6, 2015

(54) WINDOW INSULATION SYSTEM AND METHOD OF OPERATING THE SAME

(71) Applicant: Dana Catharine Schwalbe, Great Mills, MD (US)

(72) Inventor: Dana Catharine Schwalbe, Great Mills, MD (US)

( * ) Notice: Subject to any disclaimer, the term of this patent is extended or adjusted under 35 U.S.C. 154(b) by 0 days.

(21) Appl. No.: 14/523,774

(22) Filed: Oct. 24, 2014

(51) Int. Cl.
*E06B 3/67* (2006.01)

(52) U.S. Cl.
CPC *E06B 3/67* (2013.01); *E06B 3/6722* (2013.01)

(58) Field of Classification Search
CPC . E06B 2009/2411; E06B 3/6722; G02B 5/24; A01G 9/1415
USPC ..... 52/171.3
See application file for complete search history.

(56) References Cited

U.S. PATENT DOCUMENTS 4,093,352 A * 6/1978 Pisar ..... 359/886
5,511,601 A * 4/1996 Worthington ..... 160/176.1 P
5,787,652 A * 8/1998 Tai ..... 52/171.3
6,216,688 B1 * 4/2001 Schwarz ..... 126/633
6,701,681 B2 * 3/2004 Kim ..... 52/171.3

OTHER PUBLICATIONS

Steve Baer's Beadwall Insulated Window Panels, motherearthnews.com, plans for the beadwall insulated window panels, Sep./Oct. 1974.*

* cited by examiner

*Primary Examiner* — Jeanette E Chapman
*Assistant Examiner* — Daniel Kenny
(74) *Attorney, Agent, or Firm* — Jonathan A. Tyler

(57) ABSTRACT

A window insulation system includes a window installed in a wall of a house. The window includes an enclosed space defined between first and second window panes, and at least one opening located on a side of the enclosed space. An insulating material reservoir is adapted to store insulating material, and is coupled to the opening by one or more pipes. A pump system causes a first flow of air through the pipes, causing the insulating material to flow from the insulating material reservoir into the enclosed space, filling the enclosed space with insulating material. A second flow of air causes the insulating material to flow from the enclosed space to the insulating material reservoir, emptying the enclosed space of the insulating material. A controller causes the pump system to cause the first flow of air at a first predetermined time, causing the enclosed space to be filled with the insulating material, and causes the pump system to cause the second flow of air at a second predetermined time, emptying the enclosed space of the insulating material.

4 Claims, 14 Drawing Sheets

WINDOW INSULATION SYSTEM AND METHOD OF OPERATING THE SAME

TECHNICAL FIELD

This specification relates generally to systems and methods for insulating a home or other structure, and more particularly to window insulation systems and methods for operating the same.

BACKGROUND

Heating systems, air conditioning systems, and other climate control systems are commonly used in homes today. However, in operation, many existing climate control systems suffer from a variety of inefficiencies that result in unwanted energy loss and therefore increased cost. One point of inefficiency in a home climate control system is the windows of the home. A typical glass-paned window (even a double-paned window) allows much more thermal energy (i.e., heat) to escape the house than a corresponding portion (with a similar surface area) of insulated wall. Thus, during the winter, when a home heating system is operating, thermal energy generated by the heating system escapes through a window more easily than through an insulated wall. Similarly, during the summer, when an air conditioner is operating, thermal energy enters the house more easily through the windows than through insulated walls. This undesirable flow of thermal energy through the windows of a house increases the cost of heating or cooling a home.

SUMMARY

In accordance with an embodiment, a window insulation system is provided. The window insulation system includes a window installed in a wall of a house. The window includes an enclosed space defined between a first window pane and a second window pane, and at least one opening located on a side of the enclosed space. The window insulating system also includes an insulating material reservoir adapted to store insulating material, the insulating material reservoir being coupled to the at least one opening by one or more pipes. The window insulating system also includes a pump system coupled to the insulating material reservoir, the pump system being adapted to cause air to flow through the one or more pipes, wherein a first flow of air causes the insulating material to flow from the insulating material reservoir into the enclosed space, thereby filling the enclosed space with insulating material, and a second flow of air causes the insulating material to flow from the enclosed space to the insulating material reservoir, thereby emptying the enclosed space of the insulating material. The window insulating system further includes a controller adapted to control the pump system, the controller further adapted to cause the pump system to cause the first flow of air at a first predetermined time, thereby causing the enclosed space to be filled with the insulating material, and cause the pump system to cause the second flow of air at a second predetermined time, thereby emptying the enclosed space of the insulating material.

In one embodiment, the first and second window panes are substantially parallel.

In another embodiment, the insulating material comprises a foam material, such as Styrofoam. In other embodiments, other types of material may be used as the insulating material.

In another embodiment, the window further comprises at least one valve adapted to control the flow of air through the at least one opening.

In another embodiment, the window further comprises a first opening coupled to the pump system by a first pipe and a second opening coupled to the insulating material reservoir by a second pipe. The first flow of air and the second flow of air move in the same direction.

In another embodiment, the window further comprises a first valve adapted to control the flow of air through the first pipe and a second valve adapted to control the flow of air through the second pipe.

In another embodiment, the controller is further adapted to control the first and second valves, the controller being further adapted to cause the first valve to open and the second valve to close, at the first time, and cause the second valve to open, at the second time.

In another embodiment, the window comprises a single opening coupled to the insulating material reservoir by a pipe, and the first flow of air and the second flow of air move in opposite directions.

In another embodiment, the first predetermined time and the second predetermined time are determined based on a predetermined schedule, wherein the predetermined schedule defines a repeating pattern according to which the window is filled with insulating material each evening and emptied of the insulating material each morning.

In accordance with another embodiment, a method is provided. A controller causes a pump to blow insulating material into an enclosed space between two panes of a window, at a first time in accordance with a predetermined schedule. The pump is deactivated when the enclosed space is filled with the insulating material. The controller causes the pump to blow the insulating material out of the enclosed space, at a second time in accordance with a predetermined schedule.

In one embodiment, the window is located in a wall of a house.

In another embodiment, the controller causes a valve to open to allow the insulating material to flow into the enclosed space, at the first time.

In another embodiment, the controller causes a second valve to open to allow the insulating material to flow from the enclosed space, at the second time.

In another embodiment, the predetermined schedule defines a repeating pattern according to which the window is filled with insulating material each evening and emptied of the insulating material each morning.

These and other advantages of the present disclosure will be apparent to those of ordinary skill in the art by reference to the following Detailed Description and the accompanying drawings.

DETAILED DESCRIPTION

Figure 1:
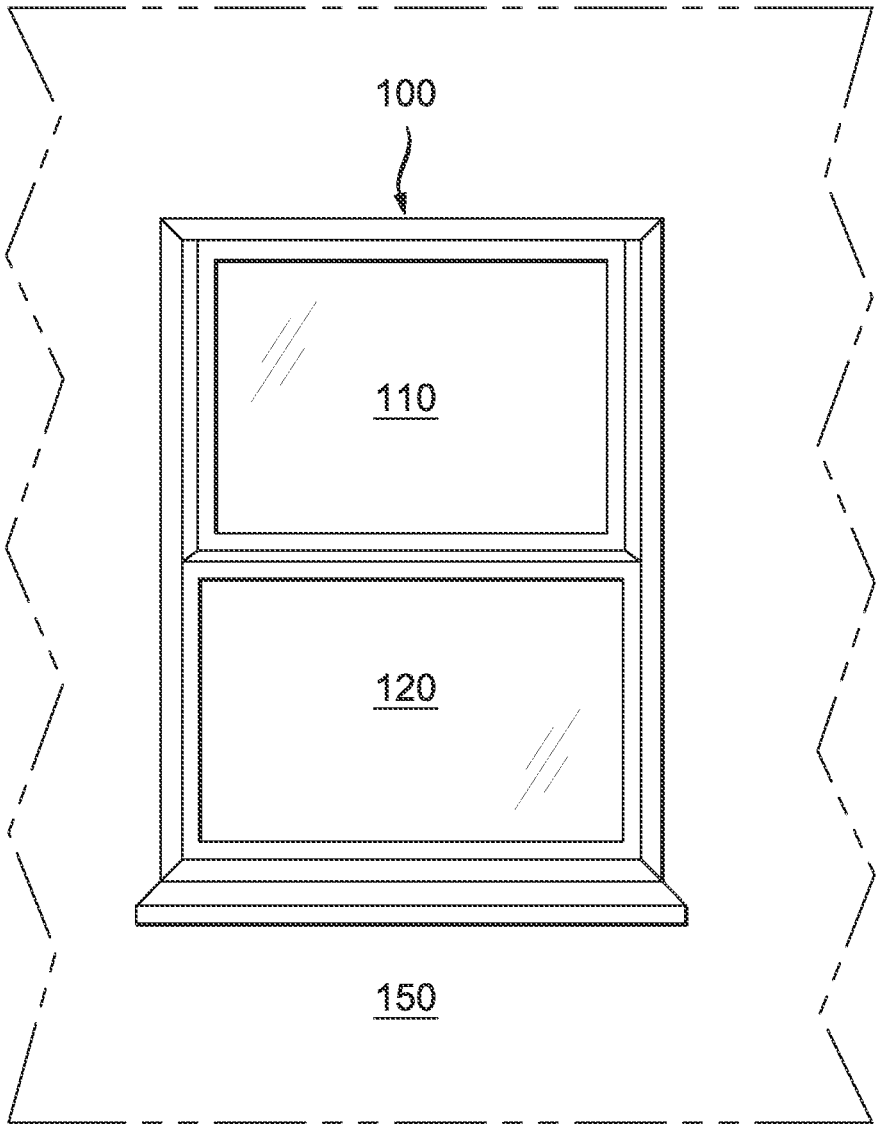
FIG. 1 shows a window located in a wall of a house.

FIG. 1 shows a window 100 disposed in a wall 150 of a house. Window 100 includes an upper pane 110 and a lower pane 120. In other embodiments, a window may include a single pane, or more than two panes.

Figure 2:
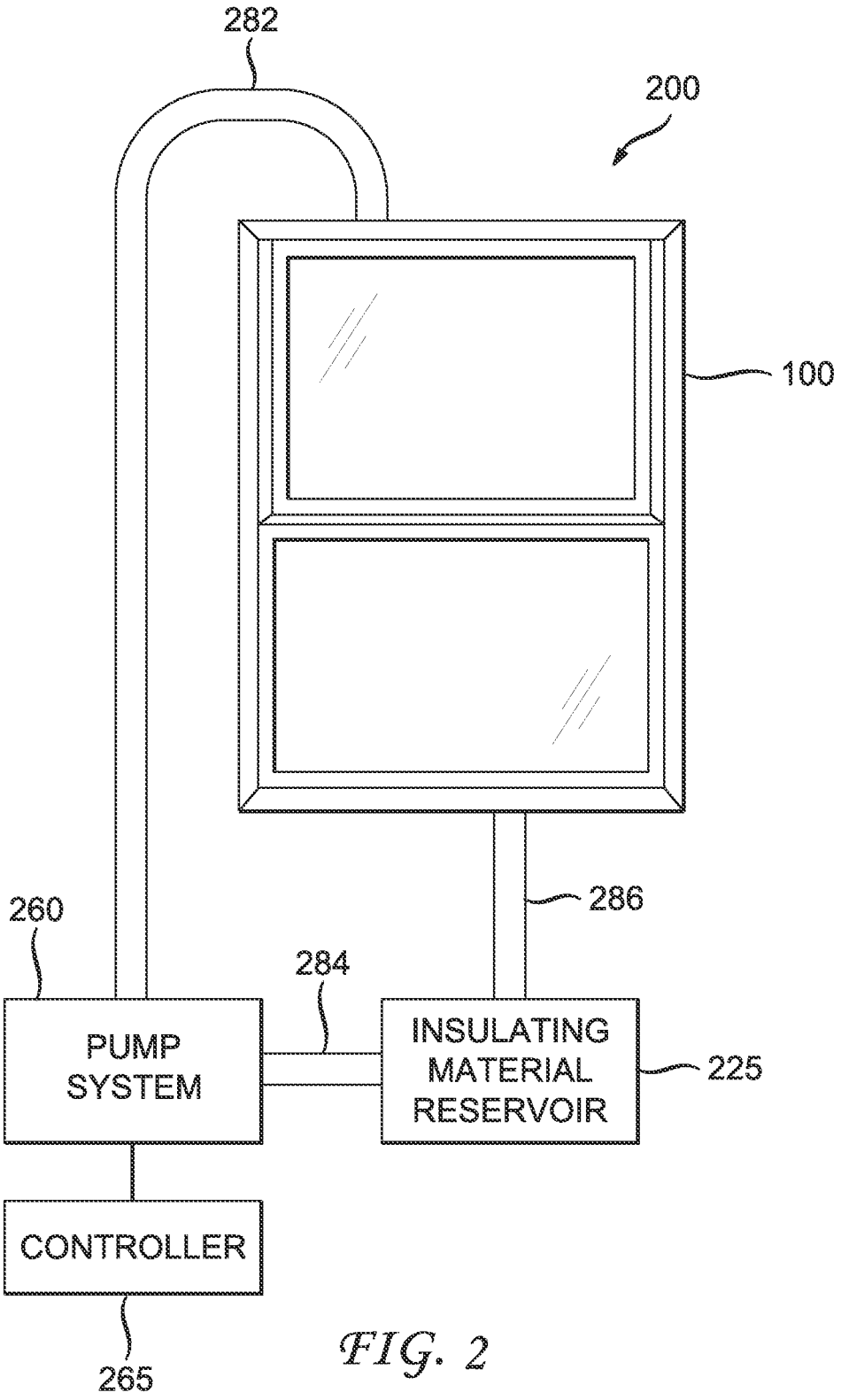
FIG. 2 shows components of a window insulation system in accordance with an embodiment.

FIG. 2 shows components of a window insulation system in accordance with an embodiment. Window insulation system 200 includes window 100, an insulating material reservoir 225, a pump system 260, and a controller 265. Controller 265 is connected to pump system 260. A pipe 286 connects to the bottom of window 100 and to insulating material reservoir 225. A pipe 284 connects insulating material reservoir 225 to pump system 260. A pipe 282 connects to pump system 260 to the top of window 100.

Controller 265 controls the operation of pump system 260. For example, controller 265 may from time to time turn pump system 260 on or off. In some embodiments, controller 265 activates pump system 260 at a first select hour of the day, and deactivates pump system at a second selected hour of the day. Controller 265 may comprise a computer or other processing device, for example.

In the illustrative embodiment, window insulation system 200 is installed behind wall 150, in a manner that is not readily visible to residents of the house. In other embodiments, window insulation system 200 may be installed in a different manner.

The configuration of components shown in FIG. 2 is illustrative only and is not to be construed as limiting. In other embodiments, a window insulation system may include other components not shown in FIG. 2, and the components may be arranged differently. For example, the components may be connected in a different manner by any number of pipes. Similarly, volume 305 may have more or fewer than two openings for connections to other components.

Figure 3:
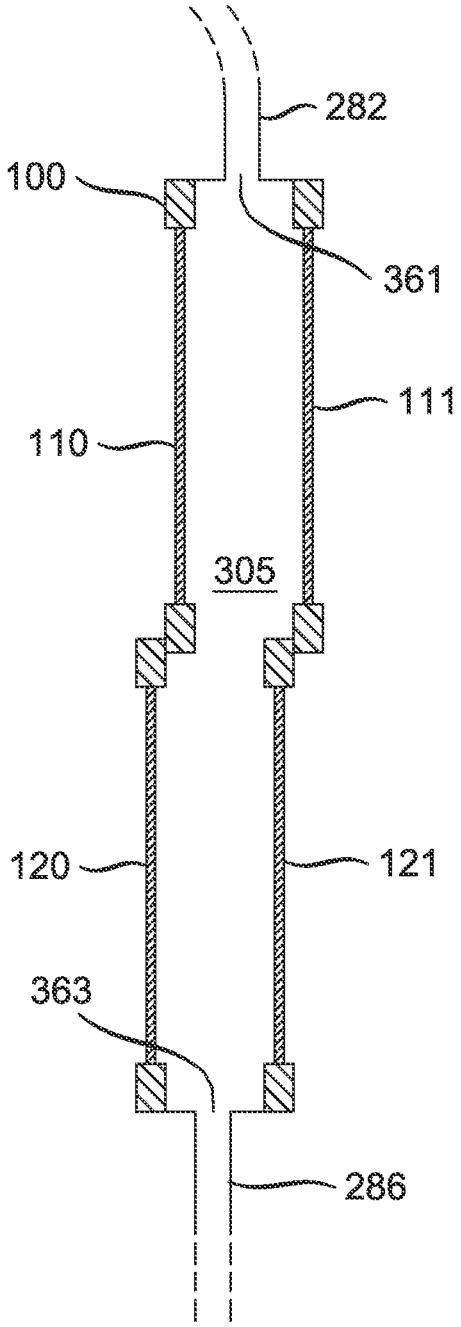
FIG. 3 shows a side view of the window of FIG. 1 in accordance with an embodiment.

FIG. 3 shows a side view of window 100 in accordance with an embodiment. Window 100 is a double-paned window with an inner pair of panes and an outer pair of panes. Specifically, upper pane 110 and lower pane 120 are the inner panes of the window as they are disposed on the interior of the house. Window 100 also includes a pair of outer panes 111 and 121 disposed on the exterior of the house. Pane 111 is an upper exterior pane opposite upper interior pane 110; pane 121 is a lower exterior pane 121 opposite lower interior pane 120. Panes 110 and 111 are substantially parallel and are separated by a first defined distance associated with the particular type of window; panes 120 and 121 are substantially parallel and are separated by a second defined distance. Panes 110, 111, 120, and 121 define a volume 305 between the window panes. The dimensions of volume 305 may vary depending on the type of window. For example, in some windows volume 305 may have a width of 2-4 inches; in other types of windows volume 305 may have a width of about 1 centimeter or less.

In other embodiments, other types of windows, and windows having other sizes and configurations, may be used. For example, a window may have only one inner pane and one outer pane, or may have multiple distinct volumes defined by respective pairs of inner and outer window panes.

Referring again to FIG. 3, pipe 282 connects to the top of window 100 at an opening 361. Pipe 286 connects to window 100 at an opening 363.

Figure 4:
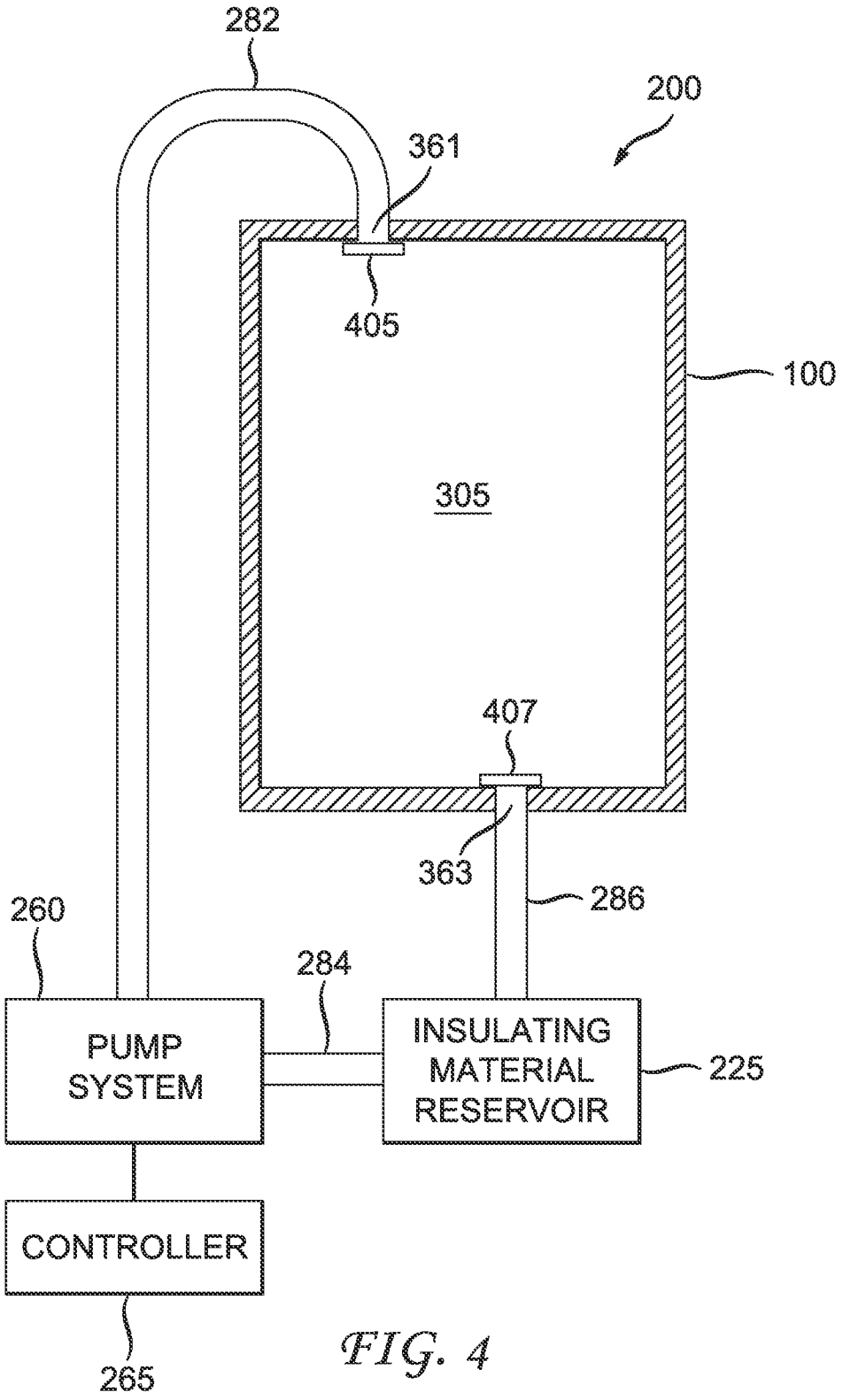
FIG. 4 shows functional components of a window insulation system in accordance with an embodiment.

FIG. 4 shows functional components of window insulation system 200 in accordance with an embodiment. As illustrated in FIG. 2, window insulation system 200 includes window 100, insulating material reservoir 225, pump system 260, controller 265, and pipes 282, 284, and 286. A valve 405 is disposed at opening 361 and is adapted to open and close in such a manner to allow air or other material to flow through opening 361 when open, and to prevent the flow of air or other material through opening 361 when closed. A valve 407 is disposed at opening 363 and is adapted to open and close in such a manner to allow air or other material to flow through opening 363 when open, and to prevent the flow of air or other material through opening 363 when closed.

In the illustrative embodiment, valves 405, 407 are shown as sliding panels. However, in other embodiments other types of mechanisms may be used to open and close openings 361 and 363. Any controllable method and/or apparatus for blocking material from traversing beyond the desired point may be used. For example, a solid object, a screen, a door, a gate, a bladder, a magnetic mechanism, an electrostatic mechanism, a restrictive mechanism, etc., may be used.

In the illustrative embodiment, controller 265 controls the operation of valves 405, 407. For example, controller 265 may be linked to valves 405, 407 by electrical connections (not shown) in a known manner. Alternatively, controller may control valves 405, 407 in another manner, such as via wireless communication, or mechanically.

In another embodiment, a separate control system may be used to operate valves 405, 407.

In another embodiment, window insulation system 200 may include more or fewer than two valves. For example, in one embodiment, a window insulation system includes valve 407 but does not include valve 405.

Insulating material reservoir 225 is adapted to store an insulating material. For example, insulating material reservoir 225 may store at least a quantity of insulating material sufficient to fill volume 305 between the panes of window 100. In the illustrative embodiment, insulating material reservoir stores a predetermined quantity of foam (e.g., Styrofoam) balls or pellets. In other embodiments, other materials may be used.

In accordance with an embodiment, pump system 260 pumps a quantity of the insulating material from insulating material reservoir 225 through pipes 284 and 282 into volume 305 of window 100 until volume 305 is filled. While the insulating material remains within volume 305, the insulating material serves as insulation. For example, in the winter the insulating material may prevent or inhibit the flow of heat through window 100 from the interior of the house to the exterior of the house. Similarly, in the summer, the insulating material may prevent or inhibit the flow of heat through window 100 from the exterior of the house to the interior of the house.

In one embodiment, window 100 may be filled with insulating material in the evening. The insulating material remains in volume 305 during the night to serve as insulation. In the morning, volume 305 is emptied of the insulating material and the window 100 remains empty (and transparent) throughout the day. In this manner, the window may function as an ordinary window during the day, and function as an insulating window during the night.

Figure 5:
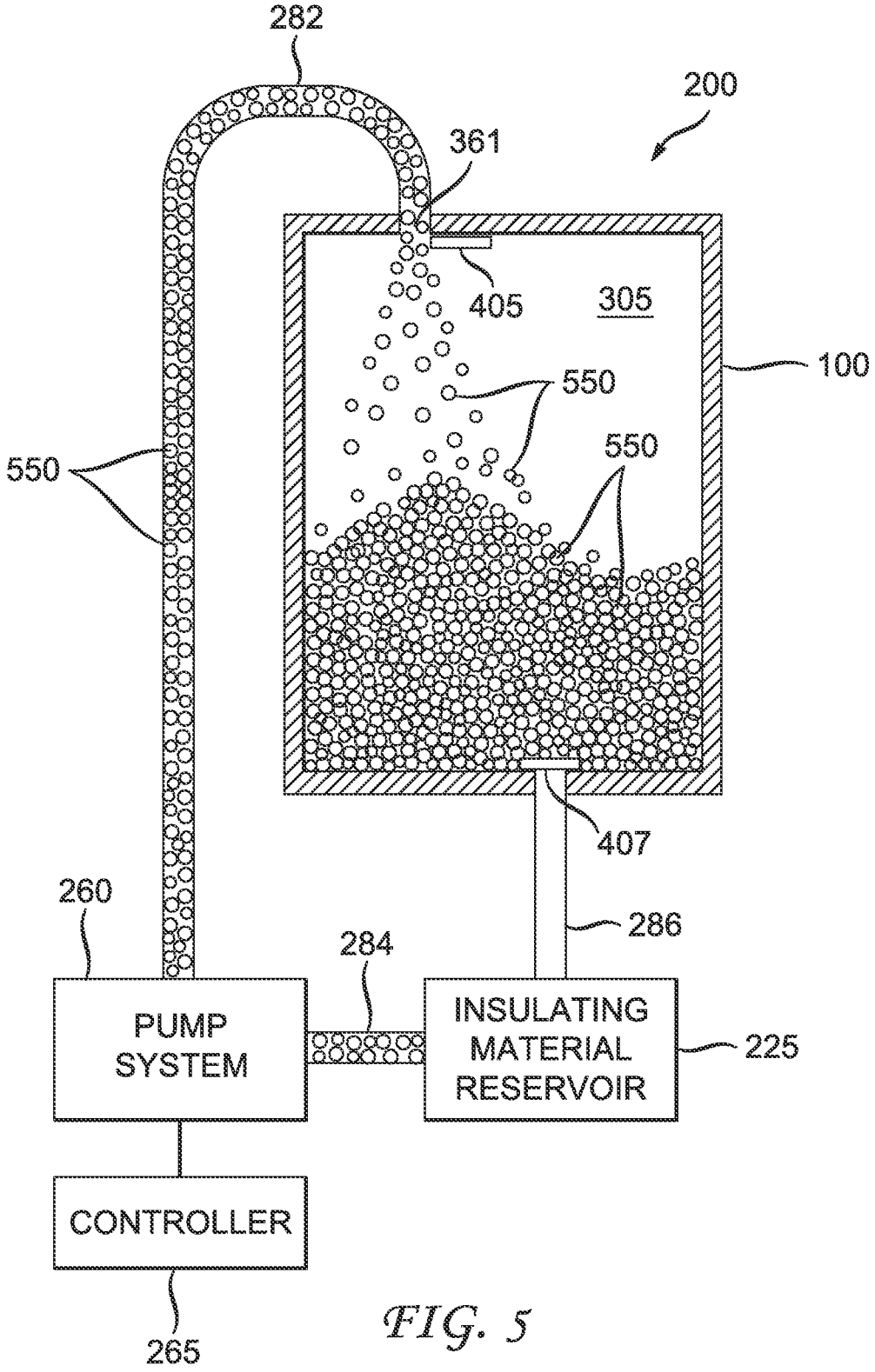
FIG. 5 shows the window insulation system of FIG. 4 when the window is partially filled with insulating material in accordance with an embodiment.

Accordingly, in an illustrative embodiment, at a predetermined time of day (e.g., a selected hour of the evening), controller 265 causes valve 407 to close, and causes valve 405 to open, as shown in FIG. 5. Controller 265 also activates pump system 260, which pumps an insulating material 550 (e.g., small balls of a foam material such as Styrofoam) from insulating material reservoir 225 through pipe 284 and through pipe 282, into volume 305 of window 100, via opening 361. Because valve 407 is closed, insulating material 550 enters window 100 via opening 361 and gradually fills volume 305 (between the inner and outer panes of window 100). FIG. 5 shows window insulation system 200 at a moment when volume 305 of window 100 is partially filled with insulating material 550. In the illustrative embodiment, insulating material comprises a foam material. In other embodiments, other types of materials may be used.

Figure 6:
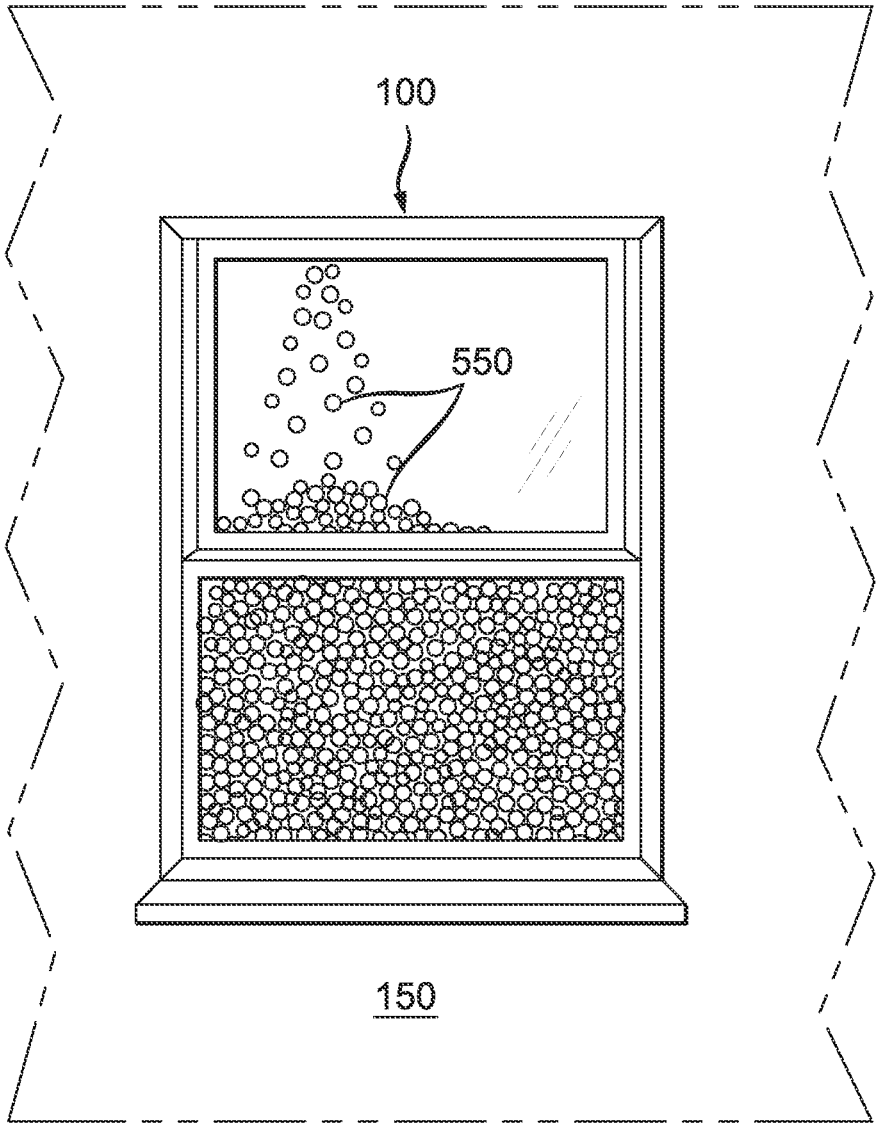
FIG. 6 shows the wall and window of FIG. 1 when the window is partially filled with insulating material.

FIG. 6 shows wall 150 and window 100 at a moment when window 100 is partially filled with insulating material 550. As window 100 becomes filled with insulating material 550, window 100 becomes opaque.

Figure 7:
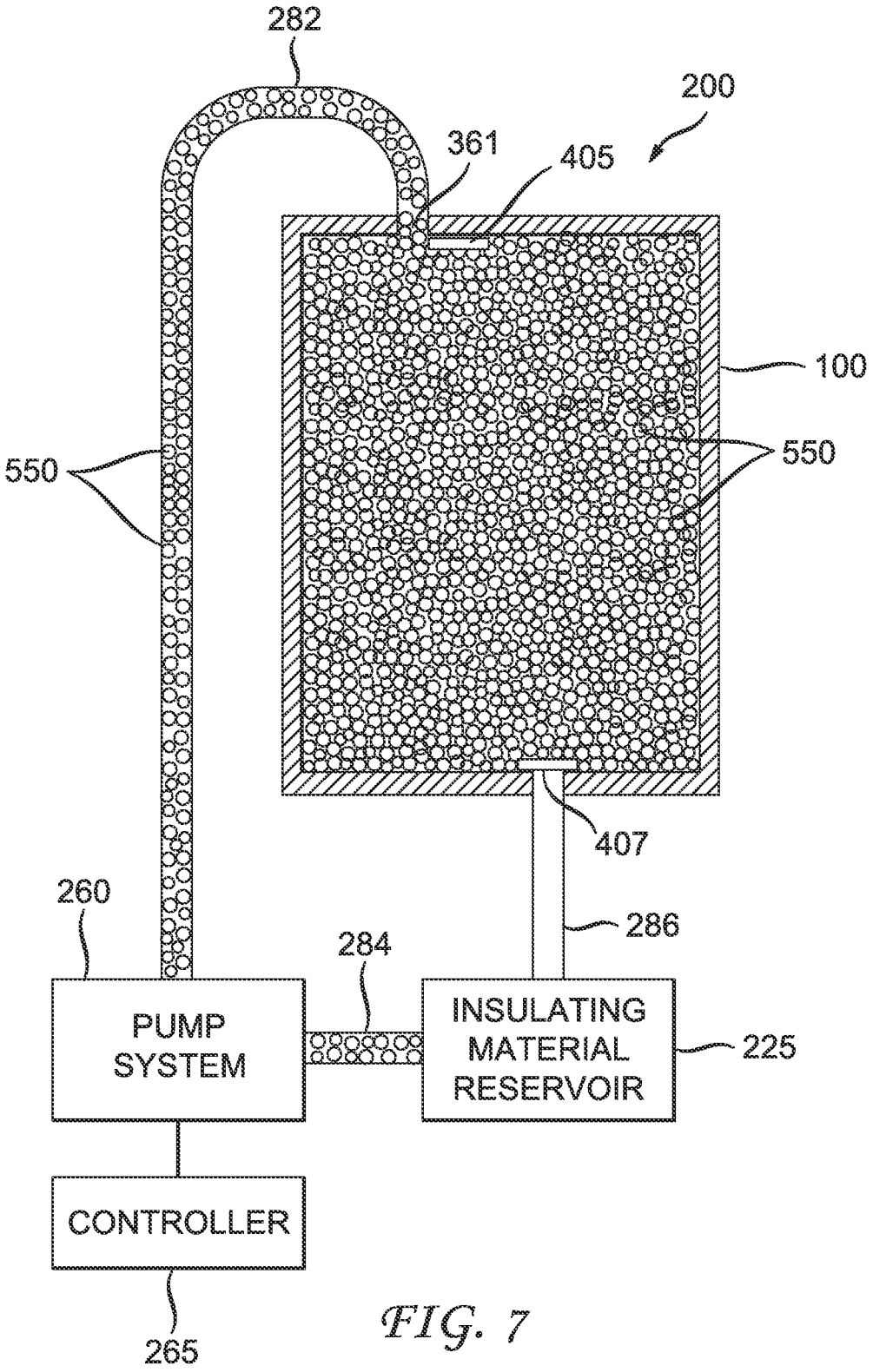
FIG. 7 shows the window insulation system of FIG. 4 when the window is filled with insulating material in accordance with an embodiment.

Pump system 260 continues to pump insulating material 550 into window 100 until volume 305 of window 100 is filled with insulating material 550. FIG. 7 shows a functional representation of window 100 at or near a moment when volume 305 of window 100 is filled with insulating material 550.

Figure 8:
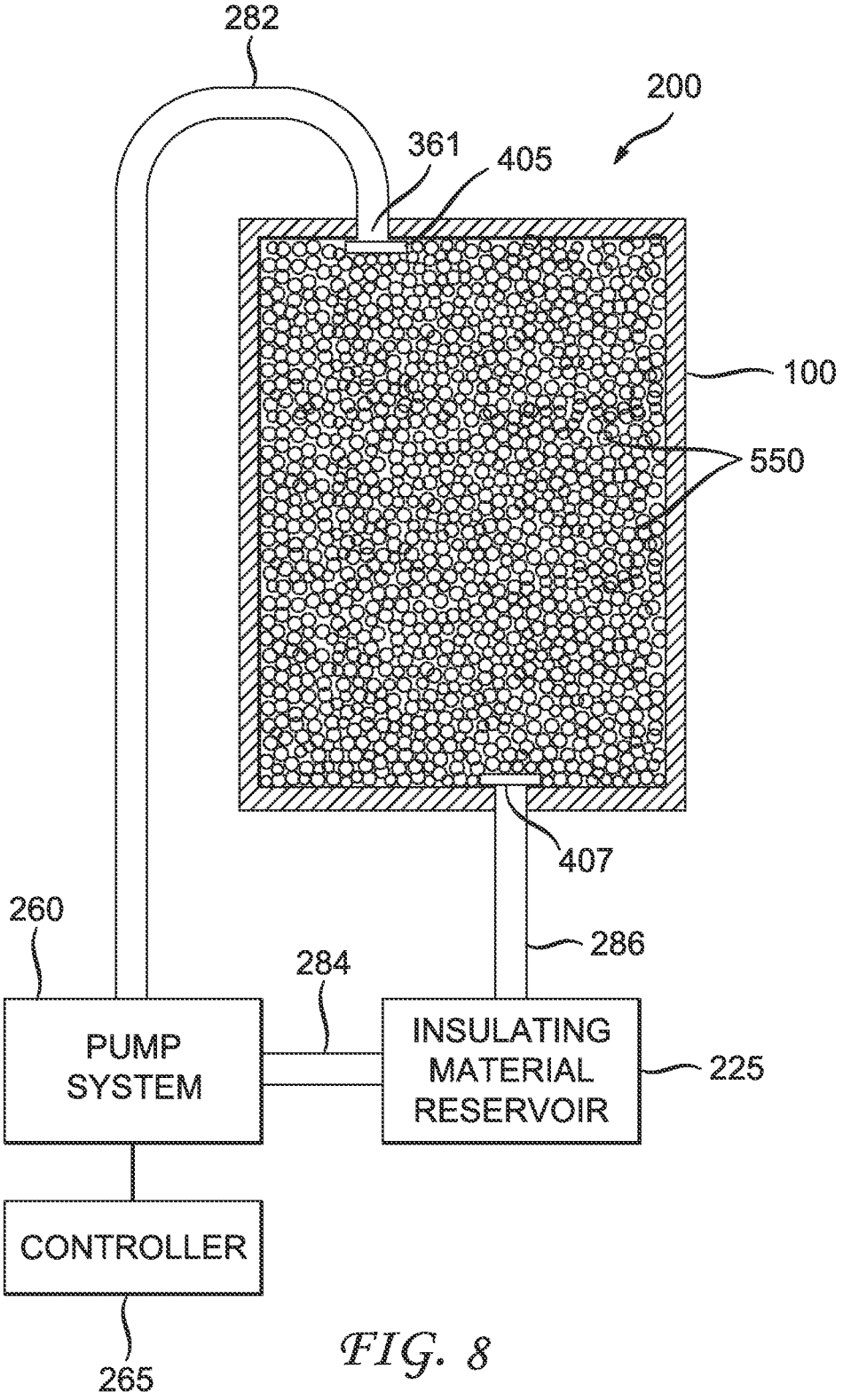
FIG. 8 shows the window insulation system of FIG. 4 when the window is filled with insulating material in accordance with an embodiment.

When volume 305 of window 100 is filled with insulating material 550, controller 265 causes valve 405 to close, preventing any additional insulating material to enter via opening 361, as shown in FIG. 8. Controller 265 also deactivates pump system 260, which accordingly stops pumping insulating material 550.

Figure 9:
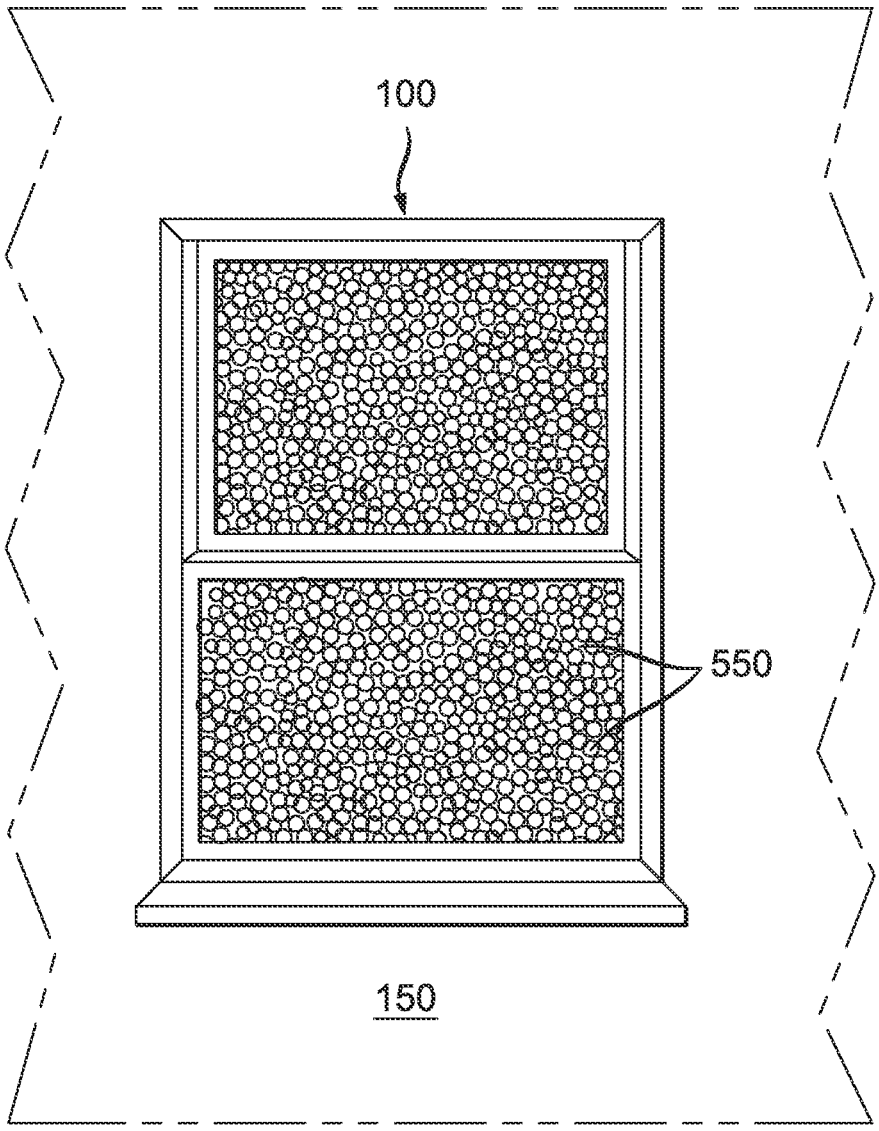
FIG. 9 shows the wall and window of FIG. 1 when the window is filled with insulating material.
Figure 10:
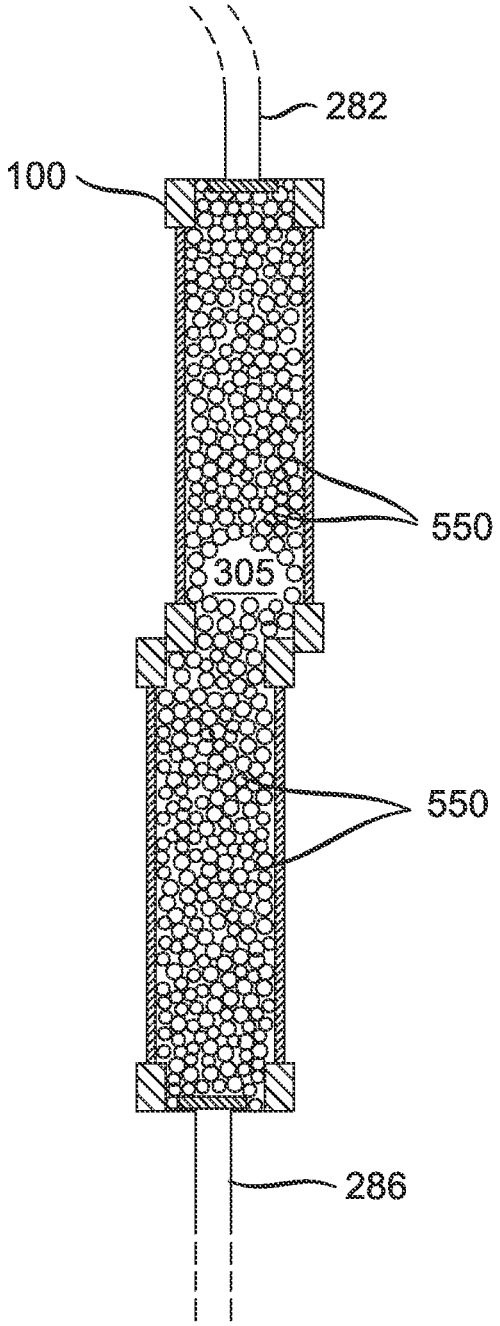
FIG. 10 shows a side view of the window of FIG. 1 when the window is filled with insulating material in accordance with an embodiment.

FIG. 9 shows wall 150 and window 100 when window 100 is filled with insulating material 550. FIG. 10 shows a side view of window 100 when volume 305 is filled with insulating material 550. As window 100 is now filled with insulating material 550, window 100 may function as an insulating window.

In other embodiments, controller 265 may close valve 405 and deactivate pump system 260 when window 100 is only partially filled with the insulating material.

Figure 11:
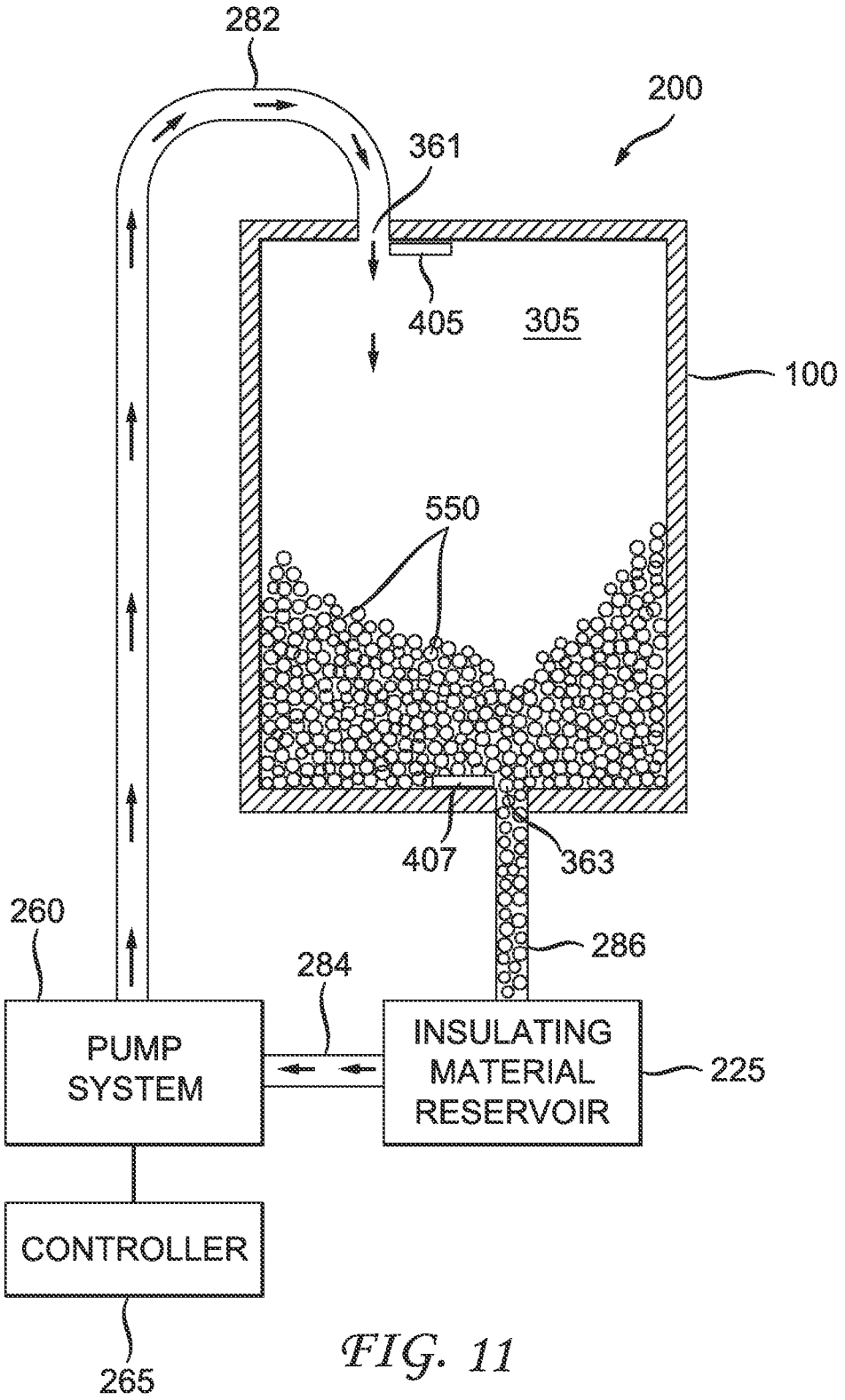
FIG. 11 shows the window insulation system of FIG. 4 when the window is partially filled with insulating material in accordance with an embodiment.

At a second predetermined time of day (e.g., a selected hour of the morning), controller 265 causes valve 405 and valve 407 to open, as shown in FIG. 11. Controller 265 also activates pump system 260, which pumps air through pipes 284 and 282 into volume 305 of window 100, via opening 361. The flow of air exerts pressure on the insulating material 550 within volume 305, causing the insulating material 550 to exit window 100 via tube 286. The insulating material 550 passes through tube 286 and enters insulating material reservoir 225, where it is stored. FIG. 11 shows window insulation system 200 at a moment when volume 305 of window 100 is being emptied of insulating material 550. Insulating material 550 is flowing from window 100 through pipe 286 into insulating material reservoir 225; however, a quantity of insulating material 550 still remains in volume 305.

Figure 12:
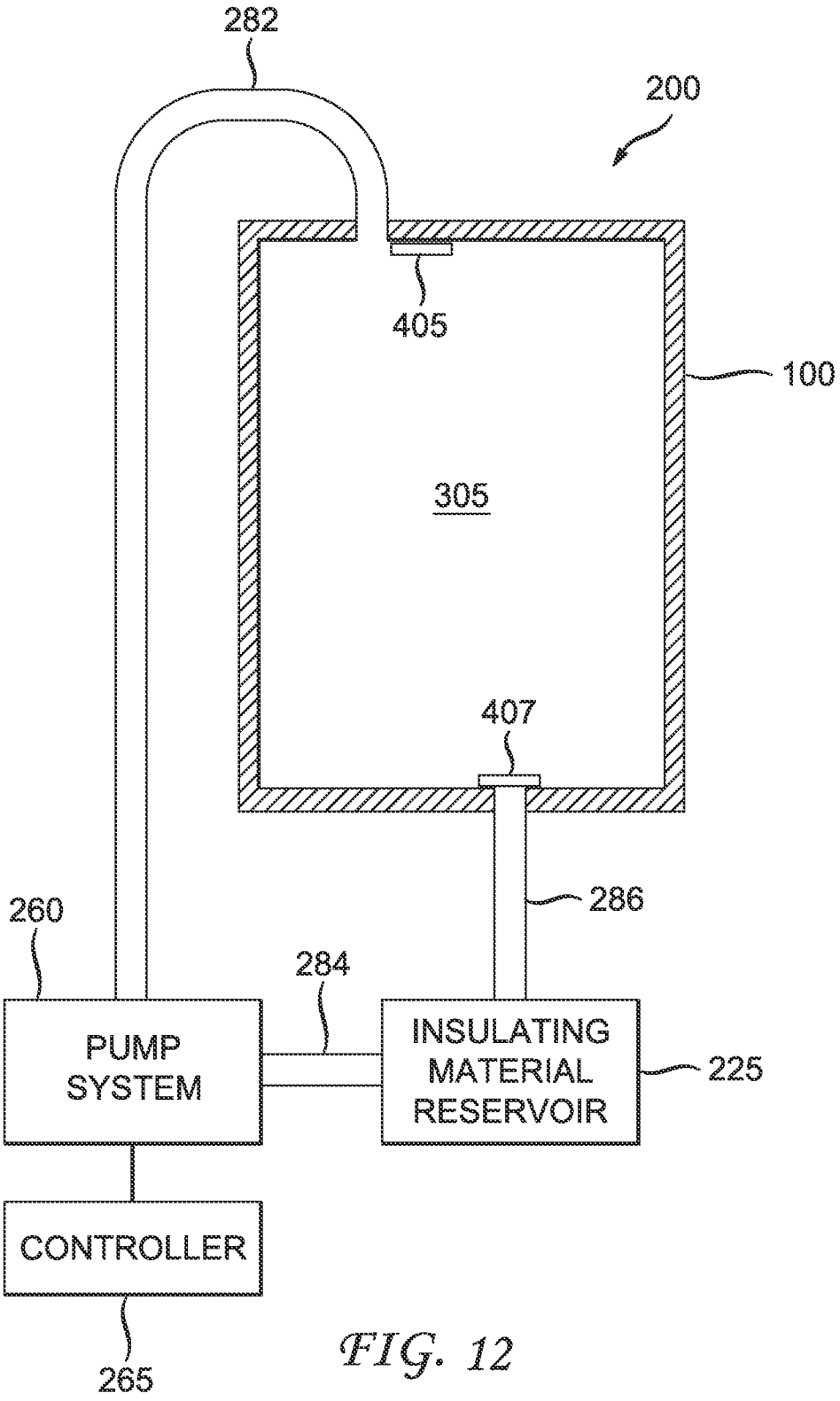
FIG. 12 shows the window insulation system of FIG. 4 when the window has been emptied of insulating material in accordance with an embodiment.

Pump 260 continues to pump air into volume 305, causing the insulating material 550 to move from window 100 into insulating material reservoir 225 until window 100 is empty, and all of the insulating material 550 is in insulating material reservoir 225. Controller 265 then deactivates pump system 260 and closes valve 407, as shown in FIG. 12. Valve 405 may also (optionally) be closed at this stage.

When window 100 is filled with insulating material 550, window 100 functions as an insulating window. Specifically, the insulating material 550 prevents or inhibits the flow of thermal energy through window 100. In various embodiments, controller 265 may control the operation of pump 260 and valves 405, 407 to cause window 100 to alternate between a first state in which it functions as a transparent, ordinary window, and a second state in which it functions as an opaque, insulating window. For example, controller 265 may cause window 100 to switch between the first state and the second state in accordance with a predetermined schedule. Such a schedule may include a repeating pattern, such that, for example, window 100 functions as a transparent window during daylight hours and as an insulating window during nighttime hours. Controller 265 may vary the schedule according to the season. For example, in certain months during the spring and fall (when the outside temperature is pleasant during the day and night), controller 265 may not activate pump system 260 at all. In one embodiment, the schedule may be determined by a user.

Figure 13:
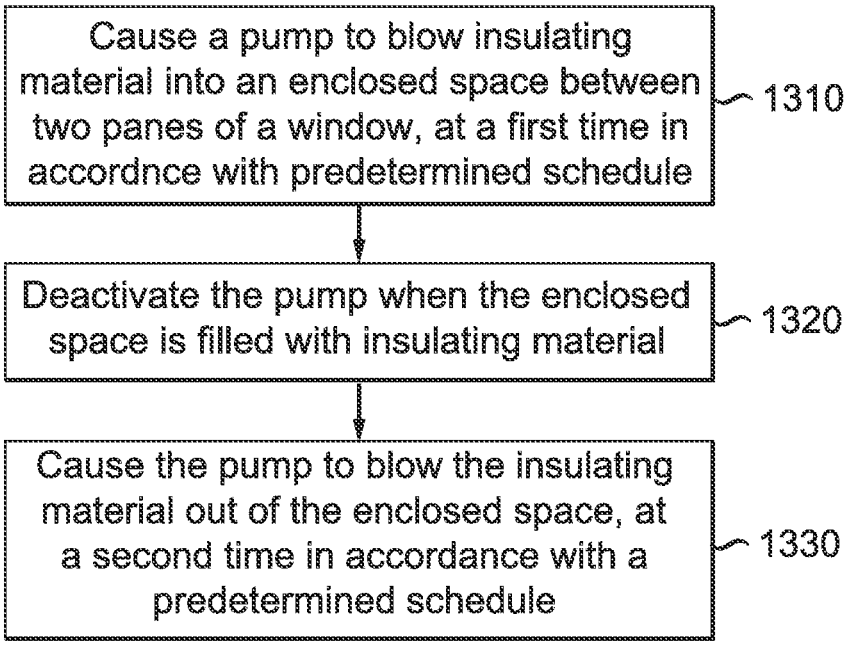
FIG. 13 is a flowchart of a method of controlling a window insulation system in accordance with an embodiment.

FIG. 13 is a flowchart of a method of controlling a window insulation system in accordance with an embodiment. At step 1310, a pump is caused to blow insulating material into an enclosed space between two panes of a window, at a first time in accordance with a predetermined schedule. At step 1320, the pump is deactivated when the enclosed space is filled with the insulating material. At step 1330, the pump is caused to blow the insulating material out of the enclosed space, at a second time in accordance with a predetermined schedule.

In one embodiment, the predetermined schedule defines a repeating pattern according to which the window is filled with insulating material each evening and emptied of the insulating material each morning.

In another embodiment, a window insulation system similar to that described above may be implemented using window screens instead of glass window panes.

In another embodiment, an insulation system that operates in a manner similar to that described above may be used to fill a space between two walls, within any enclosed space or chamber, or between other types of transparent, translucent, or opaque barriers. In this way, a degree of insulation between two walls, or inside a door, may be controlled, for example.

In other embodiments, systems, apparatus and methods described herein may be used to provide insulation with respect to other factors including, for example, heat, visible light, infrared radiation, ultraviolet radiation, electromagnetic waves, pollution, odor, sound, explosions, chemicals, fire, bullets, and any combination of such factors. Accordingly, a material suitable for a desired purpose may be selected and used as the insulating material. For example, a material that effectively blocks infrared radiation may be selected to provide insulation with respect to infrared radiation, a material that effectively blocks sound may be selected to provide insulation with respect to sound, etc.

In another embodiment, a material that reflects a particular factor (such as heat, sound, etc.) may be used. In another embodiment, a material that absorbs a particular factor (such as heat, sound, etc.) may be used. In another embodiment, a material that modifies or transforms a particular factor (such as heat, sound, etc.) may be used.

In another embodiment, the insulating material may be pumped continuously to create a partial effect, to create a desired aesthetic effect (visual or auditory), and/or to allow for continuous modification, replacement, or reprocessing of the filtering/insulating material.

In other embodiments, a window insulation system may be activated manually, or may be timed, scheduled, operated by remote control, operated via network access, etc. In other embodiments, the window insulation system may be controlled based on detected levels of one or more environmental factors, such as humidity, temperature, light levels, air quality (presence of dust, pollen, pollutants, odor), air composition (levels of carbon dioxide, carbon monoxide, oxygen, etc.), fire, chemicals, etc. For example, a window insulation system may be activated when a detected humidity in a house is greater than a predetermined level. As another example, a window insulation system may be activated when a detected temperature in the house is less than a predetermined level. In other embodiments, a window insulation system may be controlled based on other factors, such as movements detected by a motion detector, infrared levels detected by a sensor, etc.

In another embodiment, the insulating material may be pumped directly from a first window to a second window. For example, two windows may be connected by one or more pipes.

In another embodiment, the insulating material may be a solid. In another embodiment, the insulating material may be a gas. In another embodiment, the insulating material may be a liquid. A pump adapted to pump the selected insulating material may be used. It is noted that a configuration to ensure proper venting/return flow may be selected and implemented based on the materials used.

In other embodiments, other types of mechanisms may be used to fill and empty the space within a window. For example, the space may be filled and emptied using a pneumatic mechanism, a hydraulic mechanism, a magnetic-based mechanism, an electrostatic-based mechanism, an electrical-based mechanism, a tele-kinetic-based mechanism, etc.

In other embodiments, a plurality of different insulating materials may be used in combination, or a mixture of different materials may be used to achieve a desired effect.

In another embodiment, a first insulating material may be used during a first period of the day (e.g., daytime) and a second insulating material may be used during a second period of the day (e.g., nighttime).

In another embodiment, different insulating materials may be used at different times based on one or more conditions, such as time of day, temperature, room occupancy, etc.

In another embodiment, reservoir 225 may hold variable amounts of the insulating material. One or more sensors (not illustrated) disposed within window 100 may be used to determine a level of insulating material within window 100. When controller 265 determines that window 100 is filled, based on data received from the sensors, controller directs pump system 260 to stop. Alternatively, controller 265 may determine a desired quantity of insulating material needed for a desired effect, based on one or more conditions (temperature, time of day, humidity, etc., and controls pump system 260 to pump the determined quantity of material into window 100 and then to stop. For example, controller 265 may cause window 100 to be only partially filled with insulating material.

In another embodiment, the panes of window 100 are not parallel. Systems, apparatus and methods described herein may be implemented with any window pane configuration.

In various embodiments, the method steps described herein, including the method steps described in FIG. 13, may be performed in an order different from the particular order described or shown. In other embodiments, other steps may be provided, or steps may be eliminated, from the described methods.

Systems, apparatus, and methods described herein may be implemented using digital circuitry, or using one or more computers using well-known computer processors, memory units, storage devices, computer software, and other components. Typically, a computer includes a processor for executing instructions and one or more memories for storing instructions and data. A computer may also include, or be coupled to, one or more mass storage devices, such as one or more magnetic disks, internal hard disks and removable disks, magneto-optical disks, optical disks, etc.

Systems, apparatus, and methods described herein may be implemented using computers operating in a client-server relationship. Typically, in such a system, the client computers are located remotely from the server computer and interact via a network. The client-server relationship may be defined and controlled by computer programs running on the respective client and server computers.

Systems, apparatus, and methods described herein may be used within a network-based cloud computing system. In such a network-based cloud computing system, a server or another processor that is connected to a network communicates with one or more client computers via a network. A client computer may communicate with the server via a network browser application residing and operating on the client computer, for example. A client computer may store data on the server and access the data via the network. A client computer may transmit requests for data, or requests for online services, to the server via the network. The server may perform requested services and provide data to the client computer(s). The server may also transmit data adapted to cause a client computer to perform a specified function, e.g., to perform a calculation, to display specified data on a screen, etc.

Systems, apparatus, and methods described herein may be implemented using a computer program product tangibly embodied in an information carrier, e.g., in a non-transitory machine-readable storage device, for execution by a programmable processor; and the method steps described herein, including one or more of the steps of FIG. 13, may be implemented using one or more computer programs that are executable by such a processor. A computer program is a set of computer program instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Figure 14:
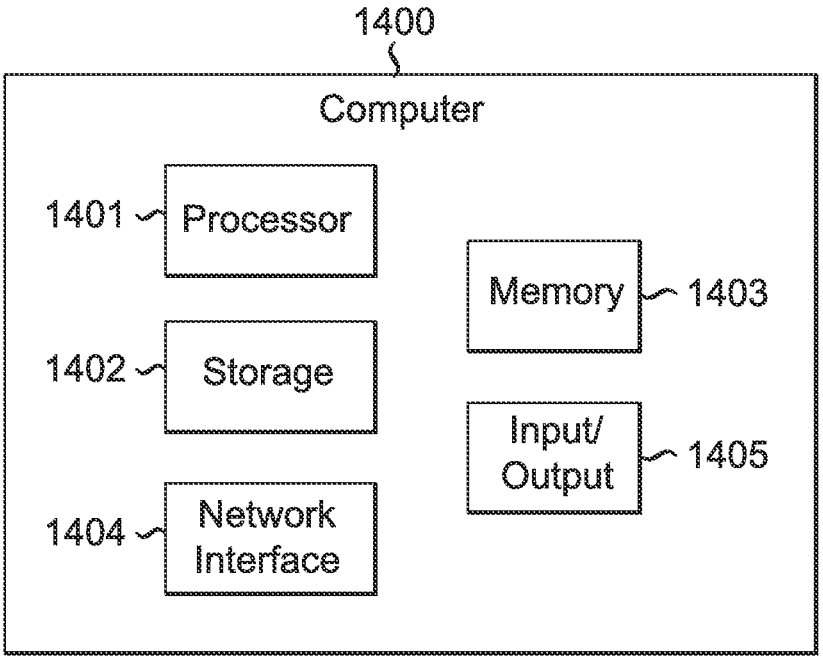
FIG. 14 shows an exemplary computer that may be used to implement certain embodiments of the invention.

A high-level block diagram of an exemplary computer that may be used to implement systems, apparatus and methods described herein is illustrated in FIG. 14. Computer 1400 includes a processor 1401 operatively coupled to a data storage device 1402 and a memory 1403. Processor 1401 controls the overall operation of computer 1400 by executing computer program instructions that define such operations. The computer program instructions may be stored in data storage device 1402, or other computer readable medium, and loaded into memory 1403 when execution of the computer program instructions is desired. Thus, the method steps of FIG. 13 can be defined by the computer program instructions stored in memory 1403 and/or data storage device 1402 and controlled by the processor 1401 executing the computer program instructions. For example, the computer program instructions can be implemented as computer executable code programmed by one skilled in the art to perform an algorithm defined by the method steps of FIG. 13. Accordingly, by executing the computer program instructions, the processor 1401 executes an algorithm defined by the method steps of FIG. 13. Computer 1400 also includes one or more network interfaces 1404 for communicating with other devices via a network. Computer 1400 also includes one or more input/output devices 1405 that enable user interaction with computer 1400 (e.g., display, keyboard, mouse, speakers, buttons, etc.).

Processor 1401 may include both general and special purpose microprocessors, and may be the sole processor or one of multiple processors of computer 1400. Processor 1401 may include one or more central processing units (CPUs), for example. Processor 1401, data storage device 1402, and/or memory 1403 may include, be supplemented by, or incorporated in, one or more application-specific integrated circuits (ASICs) and/or one or more field programmable gate arrays (FPGAs).

Data storage device 1402 and memory 1403 each include a tangible non-transitory computer readable storage medium. Data storage device 1402, and memory 1403, may each include high-speed random access memory, such as dynamic random access memory (DRAM), static random access memory (SRAM), double data rate synchronous dynamic random access memory (DDR RAM), or other random access solid state memory devices, and may include non-volatile memory, such as one or more magnetic disk storage devices such as internal hard disks and removable disks, magneto-optical disk storage devices, optical disk storage devices, flash memory devices, semiconductor memory devices, such as erasable programmable read-only memory (EPROM), electrically erasable programmable read-only memory (EEPROM), compact disc read-only memory (CD-ROM), digital versatile disc read-only memory (DVD-ROM) disks, or other non-volatile solid state storage devices.

Input/output devices 1405 may include peripherals, such as a printer, scanner, display screen, etc. For example, input/output devices 1405 may include a display device such as a cathode ray tube (CRT) or liquid crystal display (LCD) monitor for displaying information to the user, a keyboard, and a pointing device such as a mouse or a trackball by which the user can provide input to computer 1400.

Any or all of the systems and apparatus discussed herein, including controller 265, and components thereof, may be implemented using a computer such as computer 1400.

One skilled in the art will recognize that an implementation of an actual computer or computer system may have other structures and may contain other components as well, and that FIG. 14 is a high level representation of some of the components of such a computer for illustrative purposes.

Figure 15:
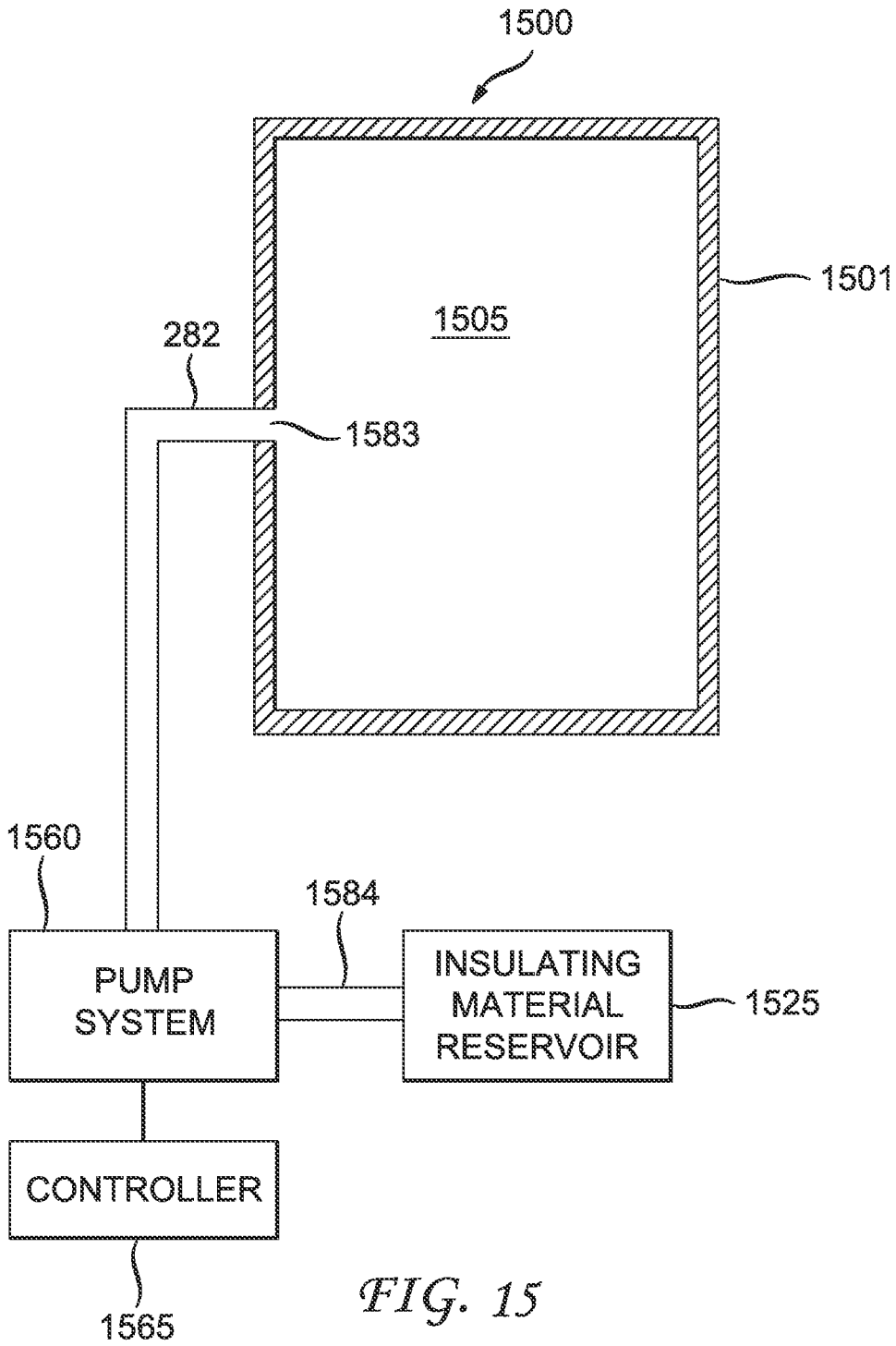
FIG. 15 shows functional components of a window insulation system in accordance with another embodiment.

FIG. 15 shows a window insulation system in accordance with another embodiment. System 1500 includes window 1501 (having a volume 1505), a pump system 1560, an insulating material reservoir 1525, and a controller 1565. Insulating material reservoir 1525 stores a quantity of an insulating material, and is coupled to pump system 1560 by a pipe 1584. Pump system 1560 is coupled to window 1501 by a pipe 1582. In this embodiment, window 1501 has a single opening 1583 through which air and insulating material flows. Pump system 1560 is adapted to cause, at a first time, a first flow of air through pipes 1584 and 1582 from insulating material reservoir 1525 into volume 1505 of window 1501, causing an insulating material to flow into volume 1505 of window 1501. Pump system 1560 is further adapted to cause, at a second time, a second flow of air in the opposite direction, from volume 1505 through pipes 1582 and 1584 into insulating material reservoir 1525, causing insulating material within volume 1505 to exit window 1501 and move into insulating material 1525. Controller 1565 is connected to pump system 1565 and controls the operation of pump system according to a predetermined schedule.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A window insulation system comprising:

a window installed in a wall of a house, the window comprising:

an enclosed space defined between a first window pane and a second window pane; and at least one opening located on a side of the enclosed space;

an insulating material reservoir adapted to store insulating material, the insulating material reservoir being coupled to the at least one opening by one or more pipes;

a pump system coupled to the insulating material reservoir, the pump system being adapted to cause air to flow through the one or more pipes, wherein a first flow of air causes the insulating material to flow from the insulating material reservoir into the enclosed space, thereby filling the enclosed space with insulating material, and a second flow of air causes the insulating material to flow from the enclosed space to the insulating material reservoir, thereby emptying the enclosed space of the insulating material; and a controller adapted to control the pump system, the controller further adapted to:

cause the pump system to cause the first flow of air at a first predetermined time, thereby causing the enclosed space to be filled with the insulating material; and cause the pump system to cause the second flow of air at a second predetermined time, thereby emptying the enclosed space of the insulating material;

wherein:

the window further comprises a first opening coupled to the pump system by a first pipe and a second opening coupled to the insulating material reservoir by a second pipe; and the first flow of air and the second flow of air move in the same direction;

wherein the window further comprises a first valve adapted to control the flow of air through the first and a second valve adapted to control the flow of air through the second pipe; and wherein the controller is further adapted to control the first and second valves, the controller being further adapted to:

cause the first valve to open and the second valve to close, at the first time; and cause the second valve to open, at the second time.

2. The window insulation system of claim 1, wherein the first and second window panes are substantially parallel.

3. The window insulation system of claim 1, wherein the insulating material comprises a foam material.

4. The window insulation system of claim 1, wherein the first predetermined time and the second predetermined time are determined based on a predetermined schedule, wherein the predetermined schedule defines a repeating pattern according to which the window is filled with insulating material each evening and emptied of the insulating material each morning.

* * * * *